United States Patent [19]

Weiss et al.

[11] Patent Number: 4,766,346

[45] Date of Patent: Aug. 23, 1988

[54] LAMP WITH LOW-TOXICITY, MOLYBDENUM-COMPATIBLE SEALING GLASS

[75] Inventors: Werner Weiss, Stadtbergen; Ewald Pösl, Kissing, both of Fed. Rep. of Germany

[73] Assignee: Patent Treuhand Gesellschaft für elektrische Glülampen mbH, Munich, Fed. Rep. of Germany

[21] Appl. No.: 43,189

[22] Filed: Apr. 27, 1987

[30] Foreign Application Priority Data

May 12, 1986 [DE] Fed. Rep. of Germany ..... 3615944

[51] Int. Cl.[4] ..... H01K 1/22; H01K 1/38; H01K 1/40

[52] U.S. Cl. ..... 313/579; 313/623; 313/318; 313/332; 501/15; 501/75

[58] Field of Search ..... 313/318, 331, 332, 623, 313/579; 501/15 (U.S. only), 75 (U.S. only)

[56] References Cited

U.S. PATENT DOCUMENTS

| | | | |
|---|---|---|---|
| 2,889,952 | 6/1959 | Claypoole | 313/317 X |
| 3,211,826 | 10/1965 | Holcomb et al. | 313/318 X |
| 3,259,777 | 7/1966 | Fridrich | 313/570 |
| 3,588,315 | 6/1971 | Levand, Jr. et al. | 313/623 X |
| 3,645,761 | 2/1972 | Kawamura et al. | 501/15 |
| 4,492,814 | 1/1985 | Snell et al. | 313/332 X |
| 4,493,944 | 1/1985 | Snell et al. | 313/332 X |
| 4,522,925 | 6/1985 | Pirooz | 501/15 |

FOREIGN PATENT DOCUMENTS

| | | | |
|---|---|---|---|
| 0048120 | 2/1984 | European Pat. Off. . | |
| 2064216 | 6/1981 | United Kingdom | 313/623 |

OTHER PUBLICATIONS

Inorganic Glass-Forming Systems-U. of Sheffield, Glass Technology (Academic Press, London and New York, '67.

Material Information by Corning, Electrical Products Division, Electric Crucible Furnace Type, Simon Miller, publication "Crucible Furnaces", pp. 722-723.

Struktur und Kristallisation der Glaser" (Structure and Crystallization of Glasses", VEB Deutscher Verlag fuer Grundstoffidustrie, Leipzig (GRD, 1971), p. 93.

*Primary Examiner*—Palmer C. DeMeo

*Attorney, Agent, or Firm*—Frishauf, Holtz, Goodman & Woodward

[57] ABSTRACT

To provide a melt glass (10) to seal capillary spaces (9) surrounding external current supply leads (8) of molybdenum passing to molybdenum foils (6) in a pinch or press seal (7) of a high temperature, for example incandescent halogen lamp, the melt glass (10) is made of 3-10% $Bi_2O_3$, 25%-40% $B_2O_3$, remainder PbO. The melt glass has low toxicity and is molybdenum-compatible. An additive of barium oxide, in up to 15% and preferably up to only about 10%, may be added to the PbO. All quantities in mol-percent.

13 Claims, 1 Drawing Sheet

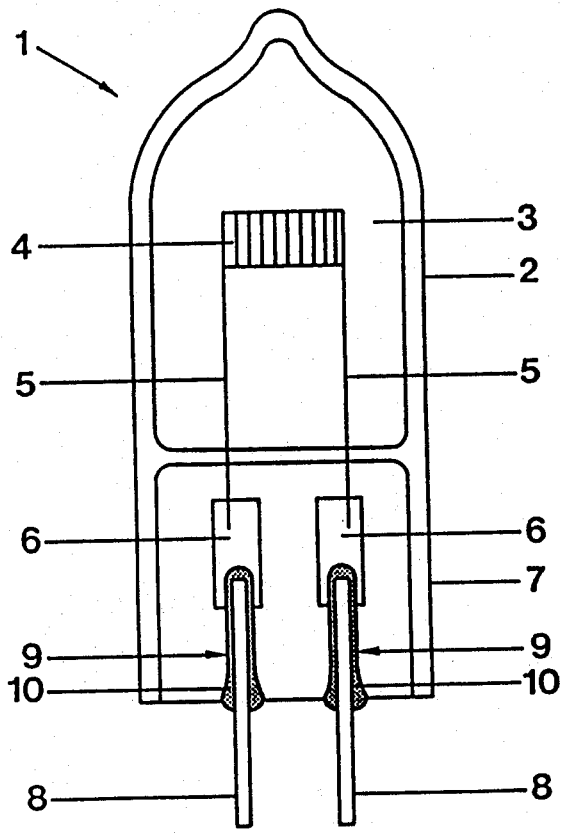
1
3
4
2
5
5
6
6
7
9
9
10
10
8
8

LAMP WITH LOW-TOXICITY, MOLYBDENUM-COMPATIBLE SEALING GLASS

The present invention relates to electric lamps, and more particularly to lamps containing a fill which includes a halide, and especially to halogen incandescent lamps or metal halogen discharge lamps.

BACKGROUND

Electric lamps which operate at high temperatures, typically lamps having a halogen containing fill, usually use current supply connections by melting a foil into a press or melt seal. Such lamps, typically, are halogen incandescent lamps or metal halide discharge lamps. The lead-in connection, of course, must be vacuum-tight.

The temperature range in the region of the pinch or press seal, where the foils are melted-in within the glass, may reach 350° C. and more. Such temperatures arise particularly in highly thermally loaded lamps. The high temperature may cause penetration of atmospheric oxygen by capillary spaces surrounding the external current supply leads. The atmospheric oxygen which thus may penetrate results in corrosion of the foils at the high temperature to which they are exposed. It has been proposed to seal such capillary spaces by a low melting point glass, which may be referred to as a solder glass or a filler glass or a sealing glass, for short hereinafter "sealing glass". Usually, the glass is a lead borate glass, which frequently has ZnO and $SiO_2$ added thereto (see, for example, the referenced U.S. Pat. No. 2,889,952). Such known lead borate glasses, however, may lead to increased corrosion of the current supply elements made of molybdenum wire, and further have unsatisfactory flow characteristics in the region of between 350° C. to 500° C.

It has been proposed to provide sealing glasses based an antimonyborate glasses—see for example U.S. Pat. No. 3,588,315. These glasses do not have corrosive effects on the molybdenum wire. Yet, the use of such sealing glasses is undesirable due to health reasons; they pose a substantial health risk.

THE INVENTION

It is an object to provide a sealing glass—which, also, may be termed a solder glass or filter glass—capable of sealing capillary spaces in the region of a press seal of a high-temperature operating lamp, which has satisfactory flow characteristics in temperature ranges of between about 350° C. to 500° C., and low toxicity, i.e. does not pose a health danger which might be the case when antimony is used, and substantially prevents corrosion of the molybdenum current supply leads.

Briefly, the sealing glass contains lead borate as well as bismuth oxide in the following combination:

3–10 mol-% $Bi_2O_3$, 25–40 mol-% $B_2O_3$, the remainder essentially containing PbO and, if desired, additional additives such as, for example, BaO in a proportion of up to about 15 mol-%. In accordance with a preferred feature of the invention, a bismuth-lead-borate sealing glass with a composition of 4–6 mol-% $Bi_2O_3$, 33–37 mol-% $B_2O_3$, remainder PbO is desirable.

The sealing glasses of the composition of the present invention combine the advantages of lead borate glasses, which are low melting and softening temperature glasses, and have good wetting characteristics in the system quartz-molybdenum with those of the antimony borate glasses, which do not corrode molybdenum. The bismuth-lead-borate sealing glasses are more difficult to reduce than the known lead-borate glasses and thus permit use of customary and usually employed molybdenum wires.

The composition in accordance with the present invention insures particularly good flow characteristics which permit the sealing glass to penetrate capillary spaces. The viscosity can be controlled to some extent by the addition of BaO. The tendency to crystallization is low, which is a further advantage of the glass.

DRAWING

The single FIGURE shows, schematically, a halogen incandescent lamp in which the present invention is used.

DETAILED DESCRIPTION

FIG. 1 shows a single-ended halogen incandescent lamp 1 of high power output, for example 250 W. The bulb 2 is made of quartz glass, but other materials may be used, such as doped quartz glass or quartz-like glass such as Vycor (Reg. TM) with a high content of silicic acid ($SiO_2$), that is, of at least and preferably over 95%. The fill 3 within the bulb contains an inert gas, such as krypton or xenon, with halogen additives, for example halogenated hydrogen compounds, halogenated hydrocarbons, or the like.

The bulb retains An incandescent filament 4 made of tungsten. The incandescent filament 4 receives electrical current from a pair of inner current supply leads 5 of molybdenum, typically molybdenum wire. The inner current supply leads 5 are connected at the inwardly directed ends of thin, essentially rectangular molybdenum foils 6, for example by welding. The molybdenum foils 6 are melted-in within the pinch or press seal 7. The opposite ends of the molybdenum foils 6 are connected to external current supply leads 8, also of molybdenum and typically molybdenum wire. The external supply leads 8 lead outwardly of the pinch or press seal 7.

The pinch or press seal 7 is made in customary and well known manner. Due to the formation of the pinch seal, and due to the different thermal coefficients of expansion of molybdenum and quartz or quartz glass of high silicon oxide content, capillary spaces 9 will form in the vicinity of the current supply leads 5, 8. The externally open capillary spaces 9 permit penetration of air, and hence the oxygen in the air up to the foils 6. Lamps which have a high operating temperature in the region of the press seal 7, for example in the order of 400° C., which is typical for high-power lamps, would be subjected to oxidation of the foils 6 at a rate substantially higher than in lamps in which the pinch or press seal is exposed only to a relatively low operating temperature. The rate of deterioration or, rather, of oxidation, has an exponential dependence on temperature. The more rapid oxidation can be prevented by filling the capillary spaces 9 leading to the external current supply leads 8 with a sealing glass 10 of the composition of the present invention.

Method of making the lamp

The region of the press seal 7 is heated to about 800° C. during manufacture of the lamp. A thin rod of drawn sealing glass is then used to touch the region at which the outer current supply leads 8 come out of the press seal 7. Due to the high temperature, the sealing glass will melt and penetrate into the capillary spaces 9. This seals the foils 6 towards the outside.

In normal operation of the lamp, temperatures which are lower than the sealing temperature and, for example, which may reach about 400° C. only, will occur in the region of the press seal. This causes the sealing glass to soften, and form a viscous melt, or a tough dough-like glass. A crystalline structure of the sealing glass under operating conditions would be undesirable since, at the crystal boundaries, diffusion gaps for oxygen from the air might form. Formation of fissures in the sealing glass after disconnection of the lamp is not critical. At that time, the temperatures are low so that the oxidizing effect of the oxygen from the air is reduced to a level at which it is no longer a problem.

Examples of formation of the sealing glass, in which all percentages are given in mol-percent.

EXAMPLE 1

Lead oxide, boron oxide and bismuth oxide are melted together at about 900° C. in a crucible Simon-Miller furnace having a crucible of hard porcelain. The composition of the sealing glass is 35% $B_2O_3$, 5% $Bi_2O_3$, 60% PbO.

In the same way, and utilizing basically the same substances, different glasses may be made in which, besides the oxides present, barium carbonate is additionally used.

EXAMPLE 2

Composition of the sealing glass: 30% $B_2O_3$, 8% $Bi_2O_3$, 10% BaO, 52% PbO.

EXAMPLE 3

Composition of the sealing glass: 35% $B_2O_3$, 5% $Bi_2O_3$, 10% BaO, 50% PbO.

The glasses of the Examples 1, 2, 3 show small differences in the crystallization behavior, and in the dependence of viscosity on temperature. The melting temperatures, corresponding to a viscosity of $10^2$ dPas, are at about 575° C. The softening temperatures, corresponding to a viscosity of $10^7$ dPas, is at about 430° C. The thermal coefficient of expansion is about $10\times10^{-6}$ $K.^{-1}$ (0°–300° C.). The transformation temperature is about 320° C., and the density about 6.29 g/cm$^3$. The application of the respective sealing glasses depends on the parameters of the specific type of lamp with which it is to be used.

The glass and the invention is not limited to halogen incandescent lamps. The invention is also particularly suitable for use in high-pressure discharge lamps using a metal halide fill. Such lamps also employ current connections with a foil melted into a pinch or press seal. Temperatures may arise in the region of the pinch or press seals of metal halide discharge lamps which also render desirable the use of sealing glasses in accordance with the present invention.

We claim:

1. An electric lamp having
- a bulb (2) of high-temperature-resistant glass;
- light generating means (4) located within the bulb;
- a fill within the bulb;
- a pinch or press seal (7) closing off at least one end of the bulb, vacuum-tight, with respect to outside ambient atmosphere;
- external current supply leads (8) passed into the pinch or press seal;
- foil means (6) electrically connected to internal current supply leads (5) and connected to the external leads (8), and sealed into the pinch or press seal; and
- a lead borate sealing glass (10) filling capillary spaces (9) which occur adjacent the external current supply leads (8) leading to the foil means (6),
- wherein the sealing glass (10) has the following composition:
  - 3–10% $Bi_2O_3$,
  - 25–40% $B_2O_3$,
  - remainder primarily PbO, all in mol percent.

2. The lamp of claim 1, wherein the remainder comprises PbO and an additive of BaO.

3. The lamp of claim 2, wherein the BaO additive is present in up to 15-mol %.

4. The lamp of claim 1, wherein the composition of the sealing glass essentially consists of:
- 4–6% $Bi_2O_3$,
- 33–37% $B_2O_3$,
- remainder primarily PbO all in mol percent.

5. The lamp of claim 1, wherein the sealing glass consists essentially of about:
- 35% $B_2O_3$, 5% $Bi_2O_3$, 60% PbO.

6. The lamp of claim 2, wherein the sealing glass consists essentially of about:
- 30% $B_2O_3$, 8% $Bi_2O_3$, 10% BaO, 52% PbO.

7. The lamp of claim 2, wherein the sealing glass consists essentially of about:
- 35% $B_2O_3$, 5% $Bi_2O_3$, 10% BaO, 50% PbO.

8. The lamp of claim 2, wherein the BaO additive is present in up to 10-mol %.

9. The lamp of claim 1, wherein the fill contains a halogen.

10. The lamp of claim 1, wherein the lamp is a halogen incandescent lamp.

11. The lamp of claim 1, wherein the lamp is a halogen high-pressure discharge lamp.

12. The lamp of claim 1, wherein the lamp operates at a temperature such that the pinch or press seal, in operation, is over about 350° C.

13. The lamp of claim 1, wherein said foil means (6) and said external current supply leads (8) consist essentially of molybdenum.

* * * * *